US009848273B1

(12) United States Patent
Helwani et al.

(10) Patent No.: US 9,848,273 B1
(45) Date of Patent: Dec. 19, 2017

(54) HEAD RELATED TRANSFER FUNCTION INDIVIDUALIZATION FOR HEARING DEVICE

(71) Applicant: Starkey Laboratories, Inc., Eden Prairie, MN (US)

(72) Inventors: Karim Helwani, Eden Prairie, MN (US); Carlos Renato Nakagawa, Eden Prairie, MN (US); Buye Xu, Eden Prairie, MN (US); Yangjun Xing, Plymouth, MN (US)

(73) Assignee: STARKEY LABORATORIES, INC., Eden Prairie, MN (US)

( * ) Notice: Subject to any disclaimer, the term of this patent is extended or adjusted under 35 U.S.C. 154(b) by 0 days.

(21) Appl. No.: 15/331,230

(22) Filed: Oct. 21, 2016

(51) Int. Cl.
*H04S 7/00* (2006.01)
*H04R 25/00* (2006.01)

(52) U.S. Cl.
CPC ..... *H04S 7/304* (2013.01); *H04R 25/407* (2013.01); *H04R 25/552* (2013.01);
(Continued)

(58) Field of Classification Search
CPC .. H04S 7/304; H04S 2400/11; H04S 2420/01; H04S 2420/07; H04R 25/407; H04R 25/552
See application file for complete search history.

(56) References Cited

U.S. PATENT DOCUMENTS 6,118,875 A 9/2000 Moller et al.
6,181,800 B1 * 1/2001 Lambrecht ..... H04S 1/002 381/17

(Continued)

FOREIGN PATENT DOCUMENTS

DE WO 2005032209 A2 * 4/2005 ..... H04S 1/005
EP 2357854 8/2011
WO WO2005032209 4/2005

OTHER PUBLICATIONS

Bilinski et al., "HRTF Magnitude Synthesis via Sparse Representation of Anthropometric Features", 2014 IEEE International Conference on Acoustic, Speech and Signal Processing, 2014, pp. 4468-4472.

(Continued)

*Primary Examiner* — Brenda Bernardi
(74) *Attorney, Agent, or Firm* — Hollingsworth Davis, LLC

(57) ABSTRACT

A hearing system includes one or more hearing devices configured to be worn by a user. Each hearing device includes a signal source that provides an input electrical signal representing a sound of a virtual source. A filter implements a head related transfer function (HRTF) to add spatialization cues associated with a virtual location of the virtual source to the electrical signal and outputs a filtered electrical signal that includes the spatialization cues. A speaker of the hearing device converts the filtered electrical signal into an acoustic signal and plays the acoustic signal to the user. The system includes motion tracking circuitry that tracks motion of the user as the user moves in a direction of a perceived location that the user perceives to be the virtual location of the virtual source. Head related transfer function (HRTF) individualization circuitry determines a difference between the virtual location and the perceived location in response to the motion of the user. The HRTF individualization circuitry individualizes the HRTF based on the difference.

20 Claims, 11 Drawing Sheets

(52) U.S. Cl.
CPC ..... *H04S 2400/11* (2013.01); *H04S 2420/01* (2013.01); *H04S 2420/07* (2013.01)

(56) References Cited

U.S. PATENT DOCUMENTS

| | | | | |
|---|---|---|---|---|
| 6,996,244 | B1 | 2/2006 | Slaney et al. | |
| 8,160,265 | B2 | 4/2012 | Mao et al. | |
| 8,428,269 | B1 | 4/2013 | Brungart et al. | |
| 2003/0059070 | A1* | 3/2003 | Ballas | H04S 1/005 381/309 |
| 2006/0056639 | A1* | 3/2006 | Ballas | H04S 1/005 381/17 |
| 2012/0183161 | A1 | 7/2012 | Agevik et al. | |
| 2012/0328107 | A1 | 12/2012 | Nystrom et al. | |
| 2015/0156599 | A1 | 6/2015 | Romigh | |
| 2015/0230036 | A1 | 8/2015 | Pedersen et al. | |
| 2015/0304790 | A1* | 10/2015 | Yamashita | G06F 21/32 381/303 |
| 2015/0348530 | A1* | 12/2015 | Findlay | G10K 11/1786 381/309 |
| 2016/0119731 | A1 | 4/2016 | Lester, III | |
| 2016/0142848 | A1* | 5/2016 | Saltwell | H04S 5/00 381/17 |

OTHER PUBLICATIONS

Duraiswami, "Introduction to HRTFs", retrieved from www.umiacs.umd.edu/users/ramani on Aug. 23, 2016, 36 pages.

Enzner, "Analysis and Optimal Control of LMS-Type Adaptive Filtering for Continuous-Azimuth Acquisition of Head Related Impulse Responses", IEEE, 2008, pp. 393-396.

Gamper et al., "Anthropometric Parameterisation of a Spherical Scatterer ITD Model with Arbitrary Ear Angles", 2015 IEEE Workshop on Applications of Signal Processing to Audio and Acoustics, Oct. 18-21, 2015, 5 pages.

Hammershoi et al., "Head-Related Transfer Functions: Measurements on 24 Human Subjects", Audio Engineering Society Convention, Mar. 24-27, 1992, 32 pages.

Jin et al., "Enabling Individualized Virtual Auditory Space using Morphological Measurements", 2000, 4 pages.

Knapp et al., "The Generalized Correlation Method for Estimation of Time Delay", IEEE Transactions on Acoustics, Speech and Signal Processing, vol. ASSP-24, No. 4, Aug. 1976, pp. 320-327.

Mohan et al., "Localization of Nonstationary Sources Using a Coherence Test", IEEE, 2003, pp. 470-473.

Moller et al., "Using a Typical Human Subject for Binaural Recording", Audio Engineering Society Convention, May 11-14, 1996, 19 pages.

Romigh, "Individualized Head-Related Transfer Functions: Efficient Modeling and Estimation from Small Sets of Spatial Samples", Dec. 5, 2012, 108 pages.

Xie, "Recovery of individual head-related transfer functions from a small set of measurements", J. Accoust. Soc. Am. 132(1), Jul. 2012, pp. 282-294.

* cited by examiner

HEAD RELATED TRANSFER FUNCTION INDIVIDUALIZATION FOR HEARING DEVICE

TECHNICAL FIELD

This application relates generally to hearing devices and to methods and systems associated with such devices.

BACKGROUND

Head related transfer functions (HRTFs) characterize how a person's head and ears spectrally shape sound waves received in the person's ear. The spectral shaping of the sound waves provides spatialization cues that enable the hearer to position the source of the sound. Incorporating spatialization cues based on the HRTF of the hearer into electronically produced sounds allows the hearer to identify the location of the sound source.

SUMMARY

Some embodiments are directed to a hearing system that includes one or more hearing devices configured to be worn by a user. Each hearing device includes a signal source that provides an electrical signal representing a sound of a virtual source. The hearing device includes a filter configured to implement a head related transfer function (HRTF) to add spatialization cues associated with a virtual location of the virtual source to the electrical signal and to output a filtered electrical signal that includes the spatialization cues. A speaker converts the filtered electrical signal into an acoustic sound and plays the acoustic sound to the user of a hearing device. The system includes motion tracking circuitry that tracks the motion of the user as the user moves in the direction of the perceived location. The perceived location is the location that the user perceives as the virtual location of the virtual source. Head related transfer function (HRTF) individualization circuitry determines a difference between the virtual location of the virtual source and the perceived location according to the motion of the user. The HRTF individualization circuitry individualizes the HRTF based on the difference by modifying one or both of a minimum phase component of the HRTF associated with vertical localization and an all-pass component of the HRTF associated with horizontal localization.

Some embodiments involve a hearing system that includes one or more hearing devices configured to be worn by a user. Each hearing device comprises a signal source that provides an electrical signal representing a sound of a virtual source. A filter implements a head related transfer function (HRTF) to add spatialization cues associated with a virtual location of the virtual source to the electrical signal and outputs a filtered electrical signal that includes the spatialization cues. Each hearing device includes a speaker that converts the filtered electrical signal into an acoustic sound and plays the acoustic sound to the user. The system further includes motion tracking circuitry to track the motion of the user as the user moves in the direction of a perceived location that the user perceives to be the location of the virtual source. The system includes HRTF individualization circuitry configured to determine a difference between the virtual location and the perceived location based on the motion of the user. The HRTF individualization circuitry individualizes the HRTF based on the difference by modifying a minimum phase component of the HRTF associated with vertical localization.

Some embodiments are directed to a method of operating a hearing system. A sound is electronically produced from a virtual source, wherein the sound includes spatialization cues associated with the virtual location of a virtual source. The sound is played through the speaker of at least one hearing device worn by a user. The motion of the user is tracked as the user moves in a direction of the perceived location that the user perceives as the location of the virtual source. A difference between the virtual location of the source and the perceived location of the source is determined based on the motion of the user. An HRTF for the user is individualized based on the difference by modifying at least a minimum phase component of the HRTF associated with vertical localization.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
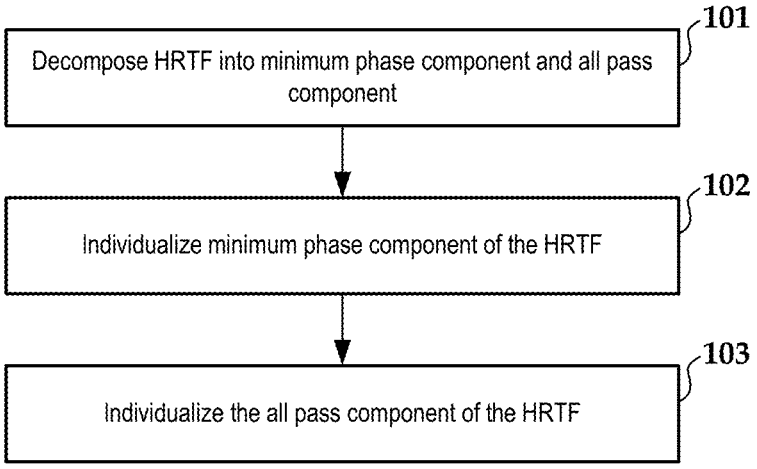
FIG. 1A is a flow diagram that illustrates an approach for individualizing an HRTF in accordance with various embodiments.

Humans are capable of locating the source of a sound in three dimensions. Locating sound sources is a learned skill that depends on an individual's head and ear shape. An individual's head and ear morphology modifies the pressure waves of a sound produced by a sound source before the sound is processed by the auditory system. Modification of the sound pressure waves by the individual's head and ear morphology provides auditory spatialization cues in the modified sound pressure waves that allow the individual to localize the sound source in three dimensions. Spatialization cues are highly individualized and include the coloration of sound, the time difference between sounds received at the left and right ears, referred to as the interaural time difference (ITD), and the sound level difference between the sounds received at the left and right ears, referred to as the interaural level difference (ILD) between ears. Sound coloration is largely dependent on the shape of external portion of the ear and allows for vertical localization of a sound source in the vertical plane while the ITD and ILD allow for localization of the sound source in the horizontal plane.

Virtual sounds are electronically generated sounds that are delivered to a person's ear by hearing devices such as hearing aids, smart headphones, smart ear buds and/or other hearables. The virtual sounds are delivered by a speaker that converts the electronic representation of the virtual sound into acoustic waves close to the wearer's ear drum. Virtual sounds are not modified by the head and ear morphology of the person wearing the hearing device. However, spatialization cues that mimic those which would be present in an actual sound that is modified by the head and ear morphology can be included in the virtual sound. These spatialization cues enable the user of the hearing device to locate the source of the virtual sound in a three dimensional virtual sound space. Spatialization cues can give the user the auditory experience that the sound source is in front or back, above or below, to the right or left sides of the user of the hearing device.

The modification of sound pressure waves of an acoustic signal by an individual's head and ear morphology when the sound source is located at a particular direction from the individual is expressed by a head related transfer function (HRTF). An HRTF data set is the aggregation of multiple HRTFs for multiple directions around the individual's head that summarizes the location dependent variation in the pressure waves of the acoustic signal. For convenience, this disclosure refers to a data set of HRTFs simply as an "HRTF" with the understanding that the term "HRTF" as used herein refers to a data set of one or more HRTFs corresponding respectively to one or multiple directions. Each person has a highly individual HRTF which is dependent on the characteristics of the person's ears and head and produces the coloration of sounds, the ITD and the ILD as discussed above.

Spatialization cues are optimal for a user when they are based on the user's highly individual HRTF. However, measuring an individual's HRTF can be very time consuming. Consequently, hearing devices typically use a generic HRTF to provide spatialization cues in virtual sounds produced by hearing devices. A generic HRTF can be approximated using a dummy head which is designed to have an anthropometric measure in the statistical center of some populations, for example. An idealized HRTF can be based on a head shaped by a bowling ball and/or other idealized structure. For a majority of the population, generic and/or idealized HRTFs provide suboptimal spatialization cues in a virtual sound produced by a hearing device. A mismatch between the generic or ideal HRTF and the actual HRTF of the user of the hearing device leads to a difference between the virtual location of the virtual source and the perceived location of the virtual source. For example, the virtual sound produced by the hearing device might include spatialization cues that locate the source of the virtual sound above the user. However, if the HRTF used to provide the spatialization cues in the virtual sound is suboptimal for the user, the user of the hearing device may perceive the virtual location of the virtual source to be below the user of the hearing device. Thus, it is useful to individualize a generic or idealized HRTF so that spatialization cues in virtual sounds produced by a hearing device allow the hearing device user to more accurately locate the source of the sound.

Embodiments disclosed herein are directed to modifying an initial HRTF to more closely approximate the HRTF of an individual. The flow diagram of FIG. 1A illustrates an approaches for individualizing an HRTF in accordance with various embodiments described herein. Individualizing the HRTF according to the approaches discussed herein involves decomposition 101 of the HRTF into a first component, referred to herein as the "minimum phase component," associated with the coloration of sound, and a second component, referred to herein as the "all-pass component," associated with the ITD or ILD. The minimum phase component of the HRTF provides localization of a sound source in the vertical plane and the all-pass component of the HRTF provides localization of the sound source in the horizontal plane. As HRTFs can be implemented as a causal stable filter, the HRTF can be factored into a minimum phase filter in cascade with a causal stable all-pass filter.

As discussed below in greater detail, after decomposing the HRTF, the minimum phase and the all-pass components can be separately and independently individualized. The minimum phase and all-pass components of the HRTF can be individualized by different processes performed at different times.

One or both of the minimum phase and the all-pass components of an initial HRTF of a hearing device can be individualized 102, 103 for the user. In some embodiments, one or both of the minimum phase and all-pass components of the HRTF are individualized based on the motion of a user wearing the hearing device. In these embodiments, individualization of the HRTF can be implemented as an interactive process in which a virtual sound that includes spatialization cues for the virtual location of the virtual source is played to the user of the hearing device. The motion of the user is tracked as the user moves in the direction that the user perceives to be the virtual location of the virtual source of the sound. When the HRTF is suboptimal for the user, the virtual location of the virtual source differs from the perceived location of the virtual source. The minimum phase component of the HRTF of the hearing device can be individualized for the user based on the difference between the virtual location of the virtual source and the perceived location. The process may be iteratively repeated until the difference between the virtual location of the virtual source and the perceived location is less than a threshold value.

The interactive process may include instructions played to the user via the virtual source. The instructions may guide the user to move in certain ways or perform certain tasks. The hearing system can obtain information based on the user's movements and/or the other tasks. The movements and task performed interactively by the user allow the hearing device to individualize the HRTF and/or other functions of the hearing system.

For example, the instructions may inform the user that one or more sounds will be played and instruct the user to move a portion of the user's body in the direction that the user perceives to be the source of the sound. The instructions may instruct the user to make other motions that are unrelated to the motion in the direction of the perceived location, may instruct the user to interact with an accessory device, and/or may inform the user when the procedure is complete, etc. For example, in some implementations, the instructions may instruct the user to move their head in the vertical plane in the direction of the perceived location to individualize the minimum phase component of the HRTF. The instructions may instruct the user to interact with the accessory device, such as a smartphone, to cause a sound to be played from the smartphone while holding the smartphone at a particular location to individualize the all-pass component of the HRTF. In another example, the instructions may instruct the user perform other movements that are unrelated to the motion in the direction of the perceived location, e.g., to move translationally, to swing the user's head from side to side, and/or to turn the user's head in the horizontal plane. These motions or actions can be used by the hearing system to individualize the all-pass component of the HRTF. Movements other than and/or unrelated to the motion in the direction of the perceived location can allow the hearing system to perform additional individualization functions, such as individualizing beamforming, noise reduction, echo cancellation and/or de-reverberation algorithms and/or determining whether the hearing devices are properly positioned, etc.

After the HRTF is individualized for the user by the approaches described herein, the individualized HRTF may be used to modify other signals, e.g., electrical signals produced by sensed sounds picked up by a microphone of the hearing device, that have inadequate or missing spatialization cues. Modifying the electrical signals representing sensed sounds using the individualized HRTF may enhance sound source localization of the sensed sounds.

Figure 1B:
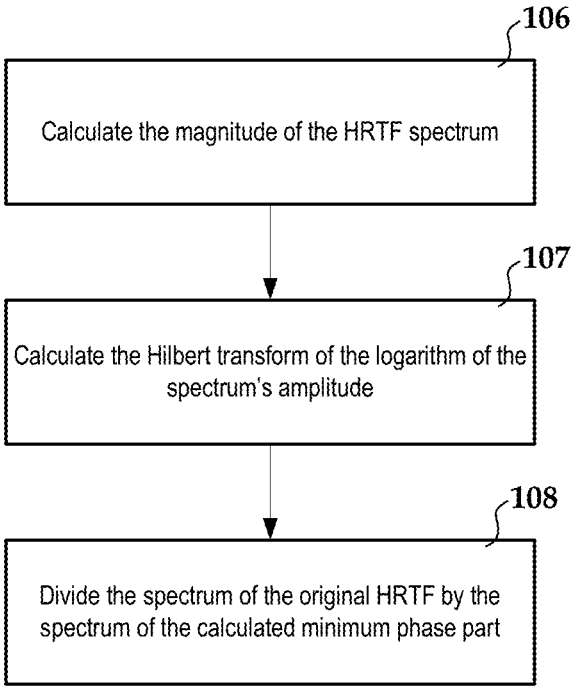
FIG. 1B is a flow diagram illustrating decomposition of an HRTF into minimum phase and all-pass components in accordance with some embodiments.

The decomposition of the HRTF into the minimum phase and all-pass components can be implemented according to the process illustrated in FIG. 1B. First, the magnitude of the spectrum of the HRTF is calculated 106. The Hilbert transform of the logarithm of the spectrum's magnitude is calculated 107. The signal resulting from the Hilbert transformation describes the phase of the minimum phase system having the magnitude calculated in step 106. The all-pass part component can be calculated 108 by dividing the spectrum of the original HRTF by the spectrum of the calculated minimum phase part.

Figure 2A:
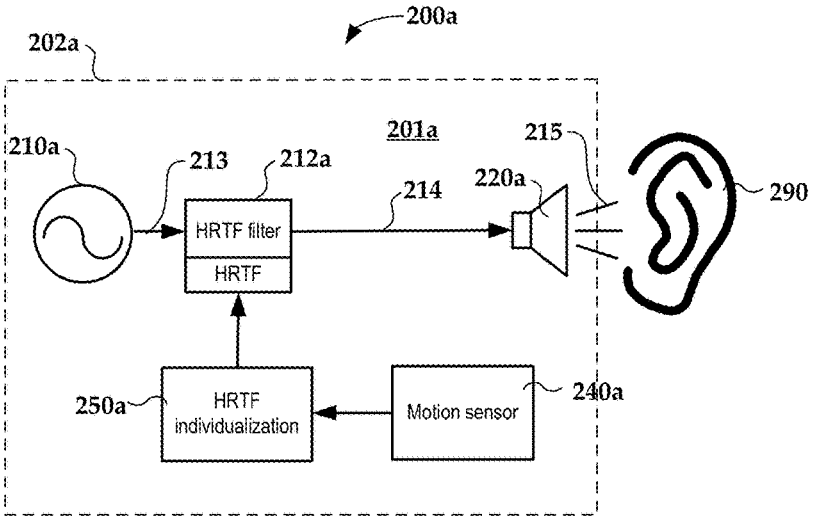
FIGS. 2A and 2B are block diagrams of hearing systems configured to individualize one or both of the minimum phase component and the all-pass component of an HRTF in accordance with some embodiments.

FIG. 2A is a block diagram of a system 200*a* configured to individualize one or both of the minimum phase component and the all-pass component of an HRTF in accordance with various embodiments. Although FIG. 2A shows a hearing system 200*a* for a single ear 290, it will be understood for this and other examples provided herein that a hearing system may include hearing devices for both ears. Such a system could be capable of individualizing the HRTFs for both left and right ears simultaneously or sequentially.

The hearing system 200*a* includes a hearing device 201*a* configured to be worn by a user in, on, or close to the user's ear 290. The hearing system 200*a* includes a signal source 210*a* that provides an electrical signal 213 representing a sound. In some implementations the signal source 210*a* is a component of the hearing device 201*a* and the electrical signal 213 is internally generated within the hearing device 201*a* by the signal source 210*a*. In some implementations, the signal source may be a microphone or a source external to the hearing device, such as a radio source.

The electrical signal 213 may not include spatialization cues that allow the user to accurately identify the virtual location of the virtual source of the sound. Filtering the electrical signal 213 by a filter 212*a* implementing the HRTF introduces monaural or binaural spatialization cues into the filtered electrical signal 214. The hearing device 201*a* includes a speaker 220*a* that converts the filtered electrical signal 214 that includes electronic spatialization cues to an acoustic sound 215 that includes acoustic spatialization cues. The acoustic sound 215 is played to the user close to the user's eardrum. When the user hears the spatialized acoustic sound 215 produced by filtered signal 214, the spatialization cues in the sound 215 allow the user to perceive a location of the virtual source of the sound 215. However, if the HRTF implemented by the filter is suboptimal for the individual, the perceived location may differ from the virtual location of the virtual source.

Initially, the spatialization cues contained within the filtered electrical signal are based on an initial HRTF, which may be a generic or idealized HRTF. The user has been instructed to move in the direction that the user perceives to be the virtual location of the virtual sound source. A motion sensor 240*a* tracks the motion of the user. The HRTF individualization circuitry 250*a* determines a difference between the virtual location of the virtual sound source and the user's perceived location of the virtual sound source. If the HRTF used to filter the electrical signal 214 to provide the spatialization cues in the spatialized sound 215 is suboptimal for the user, the spatialization cues in the sound 215 are also suboptimal. As a result, the virtual location of the virtual source differs from the user's perceived location of the virtual source. The HRTF individualization circuitry 250*a* individualizes the HRTF by modifying at least the minimum phase component of the HRTF, which adjusts the HRTF to enhance localization of the virtual sound source in the vertical plane. In some implementations the motion of the user in the direction of the perceived location can also be used to individualize the all-pass component of the HRTF, which adjusts the HRTF to enhance localization of the virtual sound source in the horizontal plane.

Figure 2B:
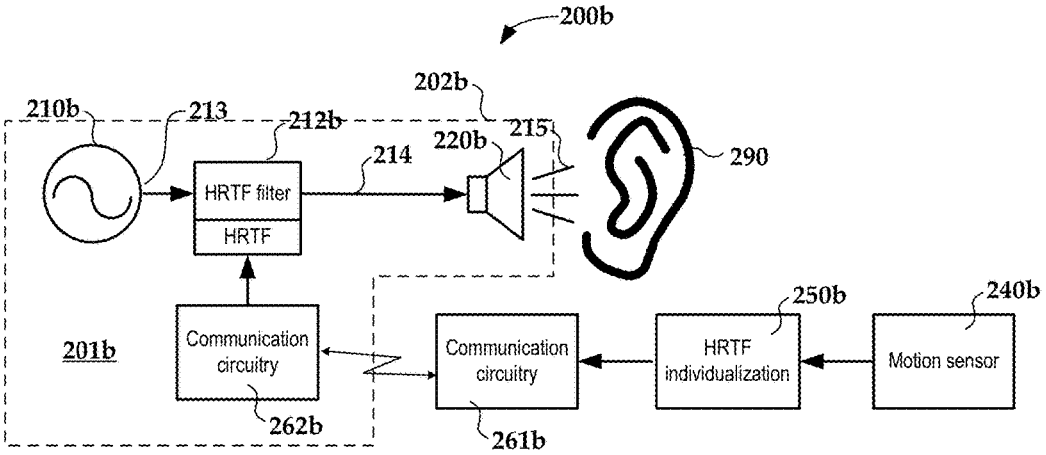

The components of a hearing system configured to individualize an HRTF for a user as described above can be arranged in a number of ways. FIGS. 2A and 2B represent a few arrangements of hearing systems 200*a*, 200*b* that provide HRTF individualization, although many other arrangements can be envisioned. For example, as illustrated in FIG. 2A, in some hearing systems, the virtual sound source 210*a*, speaker 220*a*, motion sensor 240*a*, and HRTF individualization circuitry 250*a* may be disposed within the shell of the hearing device which is conceptually indicated by the dashed line 202*a* in FIG. 2A. In embodiments where the motion sensor is internal to the hearing device, the motion sensor 240*a* may comprise an internal accelerometer, magnetometer, and/or gyroscope, for example.

In some embodiments, one or more of the components of a hearing system may be located externally to the hearing device and may be communicatively coupled to the hearing device, e.g., through a wireless link. In the hearing system 200*b* shown in FIG. 2B, the virtual sound source 210*b*, filter 212*b*, and the internal speaker 220*b* are components internal to the hearing device 201*b* and are located within the shell of the hearing device 201*b* as indicated by the dashed line 202*b*. The motion sensor 240*b* and HRTF individualization circuitry 250*b* are located externally to the hearing device 201*b* in this embodiment.

In some embodiments, the external motion sensor 240*b* may be a component of a wearable device other than the hearing device 201*b*. For example, the motion sensor 240*b* may comprise one or more accelerometers, one or more magnetometers, and/or one or more gyroscopes mounted on a pair of glasses or on a virtual reality headset that track the user's motion. In some embodiments, the external motion sensor 240*b* may be a camera disposed on a wearable device, disposed on a portable accessory device or disposed at a stationary location. In some configurations, the camera may be the camera of a smartphone. The camera may encompass image processing circuitry configured process camera images to detect motion of the head of the user and/or to detect motion of another part of the user's body. For example, the camera and image processing circuitry may be configured to detect head motion of the user, may be configured to detect eye motion as the user's eyes move in the direction of the perceived location of the sound source, and/or may be configured to detect other user motion in the direction of the perceived location. In some embodiments, the camera and image processing circuitry may be configured to detect motion of the user's arm as the user points in the direction of the perceived location of the sound source.

As illustrated in FIG. 2B, in some embodiments, the hearing system 200*b* includes communication circuitry 261*b*, 262*b* configured to communicatively couple the HRTF individualization circuitry 250*b* wirelessly to the hearing device 201*b*. For example, the HRTF individualization circuitry 250*b* may provide the individualized HRTF to the filter 212*b* through wireless signals transmitted by external communication circuitry 261*b* and received within the hearing device 201*b* by internal communication circuitry 262*b*. Through the wireless communication link, the HRTF individualization circuitry 250*b* can control the filter 212*b* to iteratively change the spatialization cues in the filtered signal 214 according to an individualized HRTF. The individualized HRTF is determined by the HRTF individualization circuitry 250*b* based on the difference between the virtual location of the virtual source and the perceived location.

Figure 3:
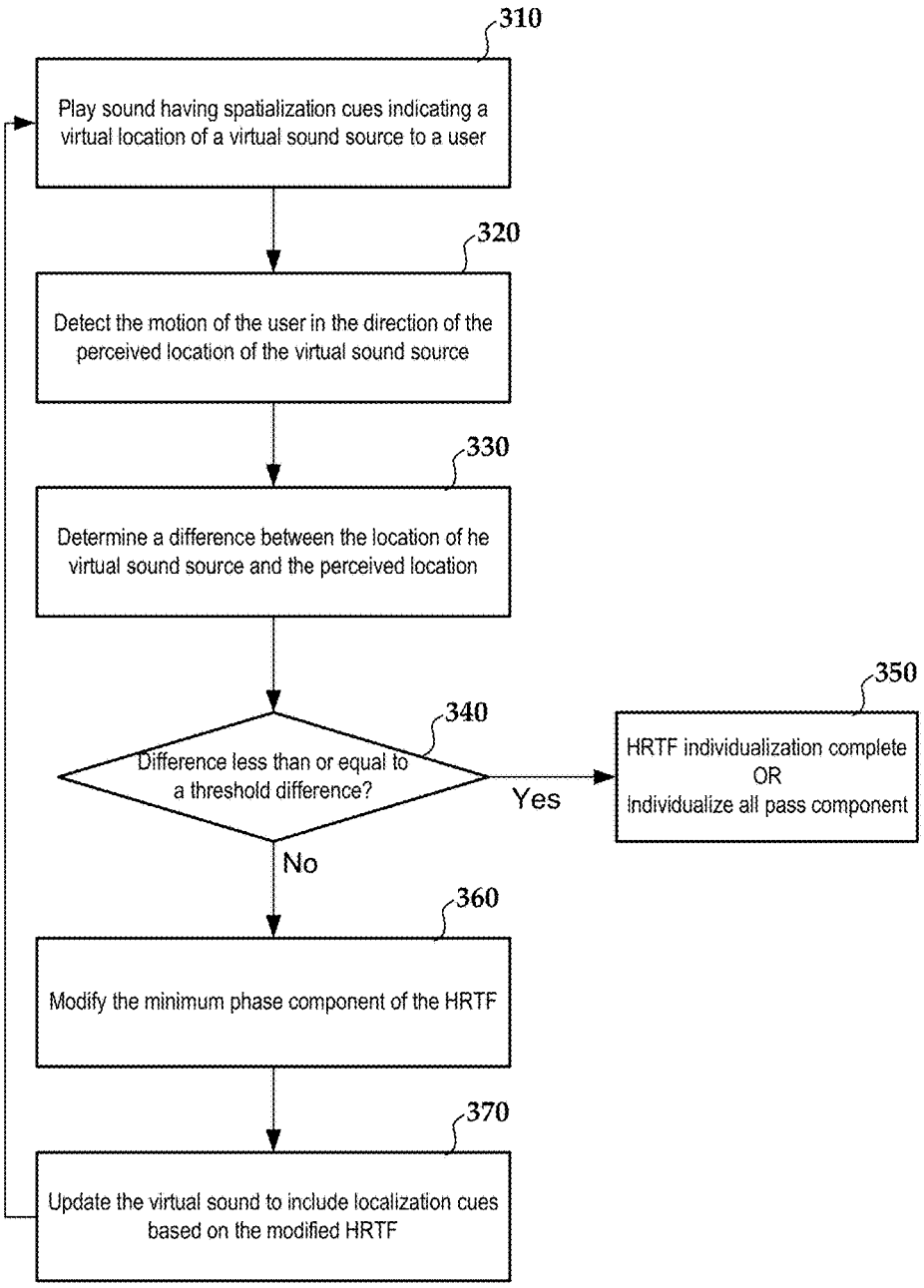
FIG. 3 is a flow diagram that illustrates a process of individualizing the minimum phase component of the HRTF in accordance with some embodiments.

FIG. 3 is a flow diagram that illustrates a process of individualizing the minimum phase component of the HRTF in accordance with some embodiments. The HRTF individualization approach outlined by FIG. 3 can be used to individualize the coloration (pinna effect) of a generic HRTF to the individual user. The individualization of the elevation perception of the HRTF is achieved adaptively in a user interactive manner.

A sound that provides spatialization cues for the virtual location of the virtual source is played 310 to the user. The sound is played out through the hearing device to the user. The sound can be a pre-recorded sound (e.g. a broadband noise signal, a complex tone, or harmonic sequence) or some audio files from the user that fits certain criteria (e.g. audio that includes high frequency components).

Initially, the sound played to the user includes spatialization cues that are consistent with an initial HRTF such as a generic or idealized HRTF that is suboptimal for the user. The sound has spatialization cues indicating a certain virtual elevation. In embodiments that include both left and right side hearing devices, the spatialization cues for the virtual elevation are provided by HRTFs for left and right sides. From this "known" virtual elevation, it is expected that the user will move their head by a certain elevation angle. The user moves their head to face the elevation that they perceive as the location of the virtual sound source (e.g., "point their nose," or in combination with an eye tracker, they can move their head and eyes). Using the motion sensors, the amount the user moves in the direction of the perceived location can be estimated.

In some embodiments, through the interactive and iterative calibration procedure, voice prompts instruct the wearer what to do. For example, during the individualization process, e.g., before, during, or after the sound is played to the user, the virtual source may play a recorded voice that informs the user about the process, e.g., telling the user to move their head in the direction that the user perceives to be the source location. Alternatively, the user may receive instructions via a different medium, e.g., printed instructions or instructions provided by a human, e.g., an audiologist supervising the HRTF individualization process. After receiving the instructions and hearing the sound of the virtual source, the user rotates (tilts) their head vertically in the direction of the user's perceived location of the source. The motion of the user in the direction of the perceived location is detected 320 by the motion sensors of the hearing system.

Figure 4A:
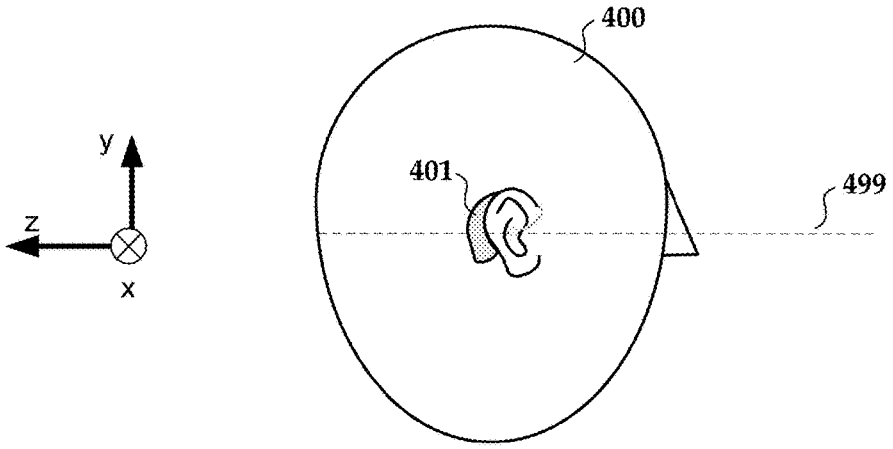
FIGS. 4A and 4B illustrate a user tilting their head in the direction of a perceived location of the source of sound.
Figure 4B:
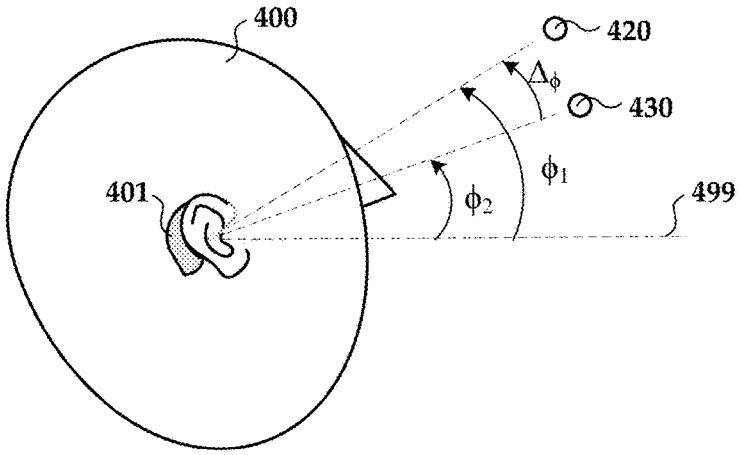

FIG. 4A shows an example orientation of the head 400 of a user wearing a hearing device 401 before the HRTF individualization process takes place. In this example, the initial vertical tilt of the user's head 400 is at 0 degrees with respect to the reference axis 499. As illustrated in FIG. 4B, the virtual location 420 of the virtual source is at an angle, $\phi_1$ with respect to the reference axis 499. However, because the HRTF used to provide the spatialization cues is suboptimal for the user, the user tilts their head to the perceived location 430 which is at an angle, $\phi_2$ with respect to the reference axis 499. The difference between the virtual location 420 of the virtual source and the perceived location 430 is $\Delta_\phi$.

Returning now to the flow diagram of FIG. 3, the difference (error) between the virtual location and the current measured head location (perceived location) is estimated/computed by the HRTF initialization circuitry. The HRTF individualization circuitry determines 330 the difference between the virtual location of the source and the perceived location, $\Delta_\phi$, and compares the difference to a threshold difference. If the difference, $\Delta_\phi$, is less than or equal to 340 the threshold difference, then the process of individualizing the minimum phase component of the HRTF may be complete 350. In some implementations, additional processes may be implemented 350 to individualize the all-pass component of the HRTF or the all-pass component of the HRTF may have been previously updated.

The HRTF individualization circuitry includes a peaking filter, such as an infinite impulse response (IIR) filter, that is designed based on $\Delta_\phi$. Depending on the sign of the error, the peaking filter may attenuate or amplify frequencies of interest (e.g. between 8 kHz-11 kHz). The magnitude and direction of such gain to be applied is dependent on the error signal. The peaking filter gain can be relatively fine, affecting a relatively narrow and specific band of frequencies, or may be relatively broad/course, affecting a broader range of frequencies, as needed. HRTFs are convolved (filtered) with this newly designed peaking filter to provide a set of individualized HRTFs. Subsequently, HRTFs are convolved (filtered) with the peaking filter to provide individualized HRTFs.

In some embodiments, an interactive process may be used to finely tune the HRTFs as outlined in FIG. 3. If the difference, $\Delta_\phi$, is greater than 340 a threshold difference, then the minimum phase component of the HRTF may modified 360 to take into account the measured difference, $\Delta_\phi$. The modified HRTF is used to provide 370 spatialization cues in the virtual sound played 310 to the user during the next iteration. This process proceeds iteratively until the difference, $\Delta_\phi$, is less than or equal to the threshold difference.

The process described in connection with FIG. 3 may be implemented to individualize HRTFs for left and right sides individually, or both left and right side HRTFs can be individualized simultaneously. For a simultaneous process, one or both of the left and right side minimum phase components of the HRTFs are modified for left and/or right side hearing systems for each iteration until the difference between the virtual location of the virtual source and the perceived location is less than the threshold difference.

In some embodiments, the HRTF individualization circuitry determines which frequency range has more of an impact on the user's localization experience. For instance, if at certain frequency bands the error signal does not seem to vary through the iterative process, then it can be deduced that such frequency ranges are not relevant. Different frequency ranges could be tested and the process can continue for finer and finer banks of peaking filters.

Figure 5:
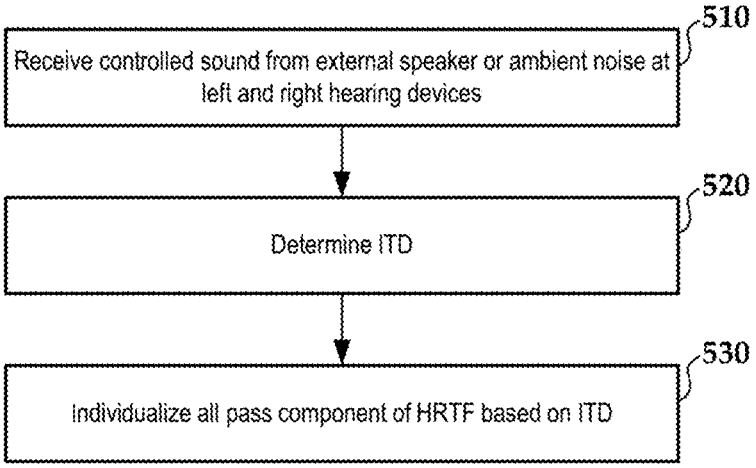
FIG. 5 is a flow diagram illustrating a process of individualizing the all-pass component of an HRTF in accordance with some embodiments.

Continuing the process from block 350 of FIG. 3, according to some embodiments, the all-pass component of the HRTF may be updated as illustrated by the flow diagram of FIG. 5. The all-pass component of the HRTF is modeled as a linear phase system. For each left and right HRTF pair, the all-pass component of the HRTF may be predominantly defined by the ITD, which is the time delay of an acoustic signal between left and right which takes into account the ITD. The ITD can be measured based on a controlled acoustic sound or ambient acoustic noise. The controlled or ambient acoustic sound is received 510 at the left and right hearing devices and the ITD is determined 520 based on the received sound. The all-pass component of the HRTF is modified 530 based on the ITD.

In some embodiments, the controlled acoustic sound used to measure the ITD is a test sequence played by an external loudspeaker, such as the speaker of a smartphone held at a distance away from the hearing devices. The acoustic sound from the smartphone is picked up by the microphones of the left and right hearing devices' microphones. A cross correlation based method, such as generalized cross correlation phase transform (GCC-Phat), can be used to compute the ITD. The GCC-PHAT computes the time delay between signals received at the left and right hearing devices assuming that the signals come from a single source. Alternatively, instead of using a controlled sound source, the ITD can be determined by fitting a coherence function model of ambient noises captured by the two microphones.

Figure 6:
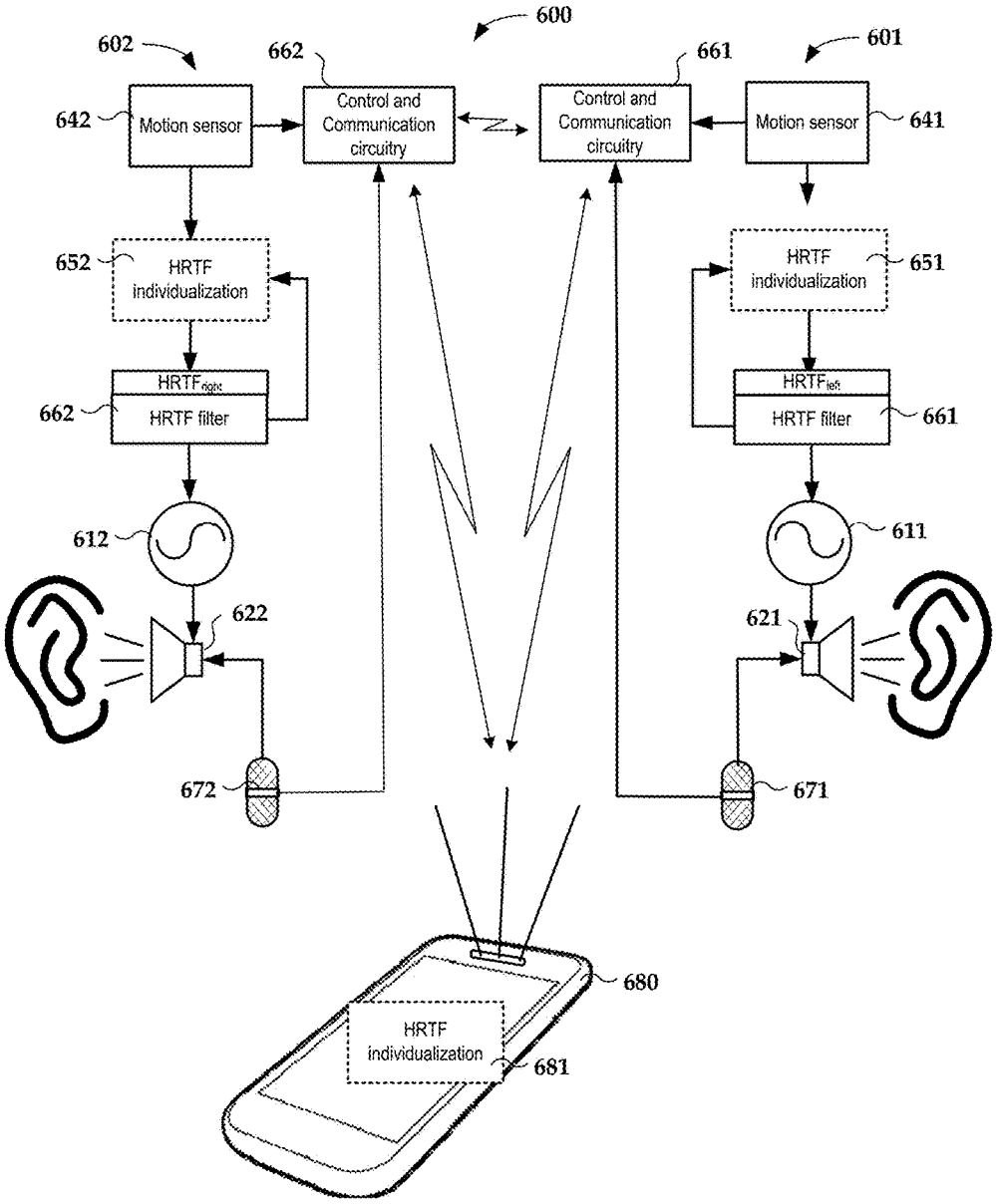
FIG. 6 is a block diagram of a hearing system capable of individualizing both the minimum phase component and the all-pass component of the HRTF in accordance with some embodiments.

FIG. 6 is a block diagram of a hearing system 600 capable of individualizing both the minimum phase component and the all-pass component of the HRTF. The hearing system 600 includes left and right hearing devices 601, 602. One or both of the hearing devices 601, 602 include HRTF individualization circuitry 651, 652 configured to modify the minimum phase component of the HRTF according to the process previously discussed and outlined in the flow diagram of FIG. 3. One or both hearing devices 601, 602 include a sound source 611, 612 that produces an electrical signal which is filtered by a filter 661, 662 implementing an HRTF. The filtered signal contains spatialization cues that allow the user of the hearing system 600 to detect the location of the sound source 611, 612. A speaker 621, 622 coupled to the virtual sound source 611, 612 converts the electrical signal to an acoustic sound that is played to the user of the hearing system 600.

Initially, the spatialization cues contained in the virtual sound are based on an initial HRTF, which may be a generic or idealized HRTF. The user has been instructed to move in the direction that the user perceives to be the virtual location of the virtual sound source. For example, the user may be instructed to rotate their head vertically in the direction of the perceived location as illustrated by FIGS. 4A and 4B. A motion sensor 641, 642 tracks the motion of the user in the direction that the user perceives to be the virtual location of the virtual sound source. The output of the motion sensor 641, 642 is used by a HRTF individualization circuitry 651, 652 to determine a difference between the virtual location of the virtual source and the user's perceived location of the source. If the HRTF used to produce the spatialization cues is suboptimal for the individual, the spatialization cues included in the virtual sound are also suboptimal. As a result of suboptimal spatialization cues, the virtual location of the virtual source differs from the user's perceived location of the source. The HRTF individualization circuitry 651, 652 modifies the minimum phase component of the HRTF to enhance localization of the sound source in the vertical plane. The process of modifying the minimum phase component of the HRTF as described above may be iteratively repeated, e.g., using spatialization cues for different virtual locations, until the difference between the virtual location and the perceived location is less than or equal to a threshold difference.

The hearing system 600 may individualize the all-pass component of the HRTF using the process previously discussed in connection with the flow diagram of FIG. 5. The all-pass component of the HRTF may be updated based on an external acoustic sound such as a controlled sound played from an external accessory device and/or uncontrolled ambient noises. FIG. 6 illustrates the source of the external acoustic sound as a smartphone 680 that plays a test sequence through its speaker. The test sequence is picked up by the microphones 671, 672 of the hearing devices 601, 602. The HRTF individualization circuitry calculates the ITD and uses the ITD to modify the all-pass component of the HRTF.

In some embodiments, communication circuitry 661, 662 communicatively links the two hearing devices 601, 602 to each other and/or to the smartphone 680 so that information from the motion sensors 641, 642 of the left and right hearing devices 601, 602, HRTF individualization circuitry 651, 652 of the left and right devices 601, 602, and/or microphones 671, 672 of the left and right hearing devices 601, 602 can be exchanged between the devices 601, 602 or between one or both devices 601, 602 and the smartphone 680 to facilitate the HRTF individualization. In FIG. 6, the HRTF individualization circuitry 651, 652, 681 is shown in dashed lines to indicate that the HRTF individualization circuitry 651, 652, 681 can optionally be implemented as a component of one of the devices 601, 602, 680. In some embodiments, the HRTF individualization circuitry may be located solely in one of the devices 601, 602, 608. In some embodiments, the HRTF individualization circuitry may be distributed between two or more of the left hearing device 601, the right hearing device 602, and the accessory device 680. The communication circuitry 661, 662 facilitates transfer of information related to the HRTF individualization process between the various devices 601, 602, 680.

Again continuing from step 350 of the flow diagram of FIG. 3, in some embodiments, the all-pass component of the HRTF may be modified based on guided motion of the user, e.g., motion in the direction of a perceived location, or on other motion of the user that is unrelated to the motion of the user in the direction of a perceived location. In addition to being used to individualize the HRTF, these motions may be used to individualize other algorithms of the hearing devices and/or to determine if the hearing devices are being worn properly as discussed in more detail herein.

Figure 7:
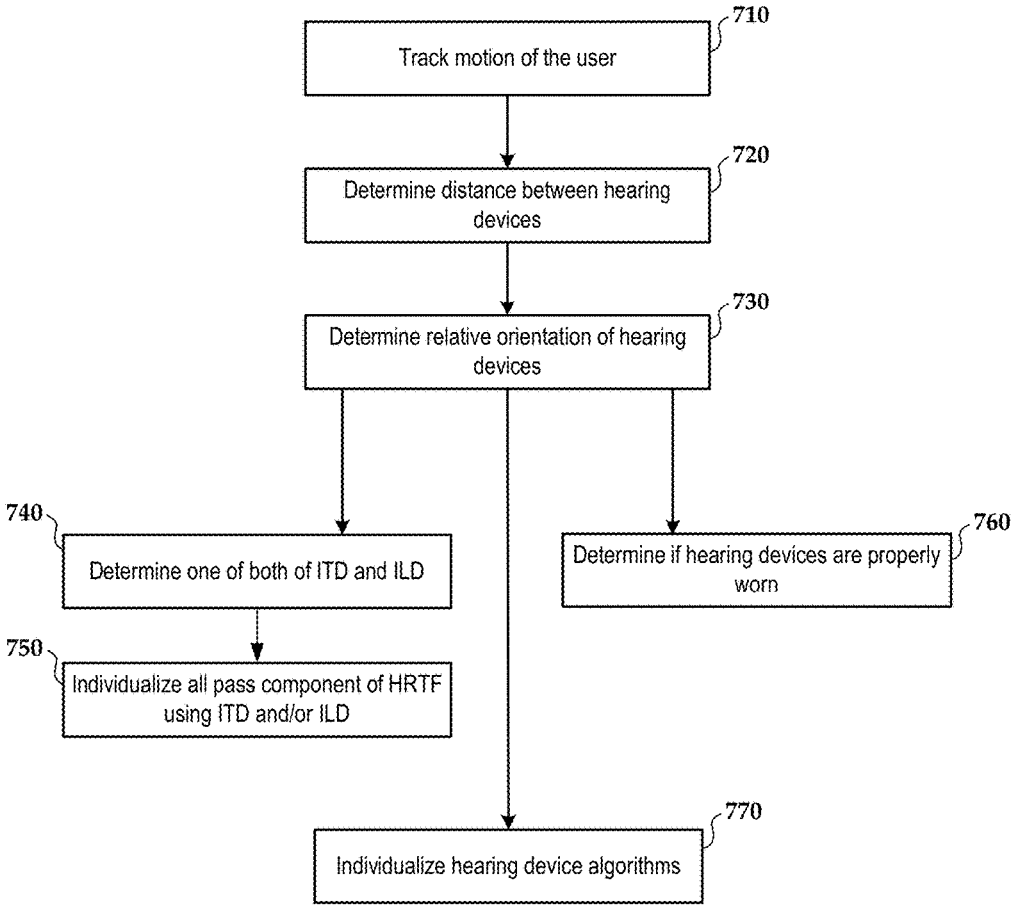
FIG. 7 is a flow diagram of a process to individualize a hearing system based on the distance between and/or relative orientations of the left and right hearing devices in accordance with some embodiments.

For example, as illustrated in the flow diagram of FIG. 7, in some embodiments, the tracked motion 710 of the user may be used to determine 720, 730 the distance and relative orientation between the left and right hearing devices.

The distance between the hearing devices can be used to perform blinded estimation 740 of the ITD and/or ILD. Assuming that the distance between the hearing devices and their relative orientation are fixed within a period of time, the distance can be estimated by tracking the translational and/or rotational motion of the both hearing devices. Based on the distance between the two hearing devices, the size of the head of the user can be estimated allowing the ITD and/or ILD to be estimated by fitting a spherical model to the user's estimated head size. The all-pass component of the HRTF can be modified 750 based on the user's estimated head size.

Figure 8A:
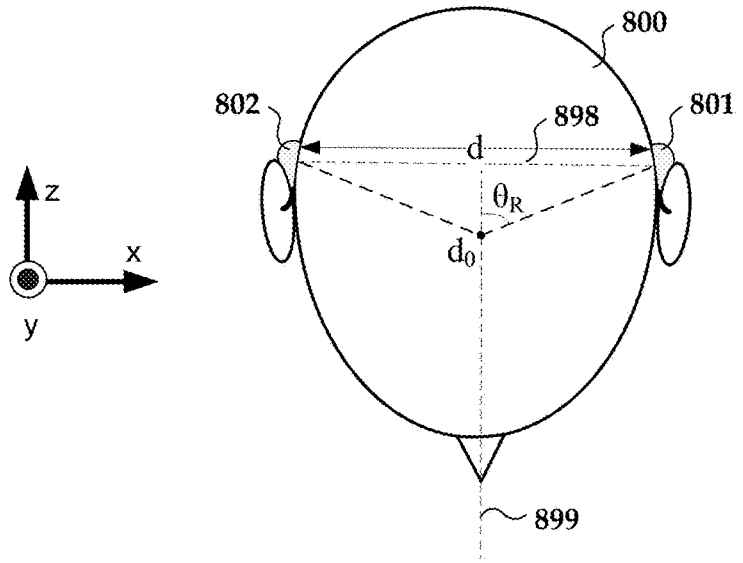
FIGS. 8A through 8D show various user motions that may be used to determine the distance and/or relative orientations between the hearing devices of a hearing system in accordance with some embodiments.
Figure 8B:
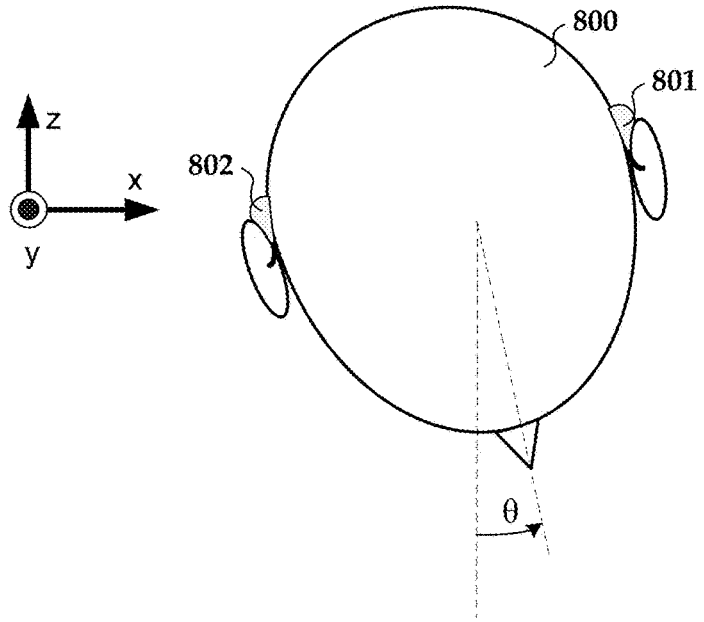
Figure 8C:
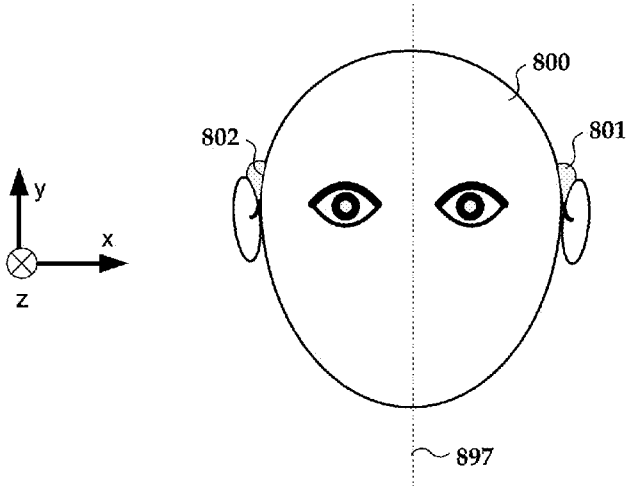
Figure 8D:
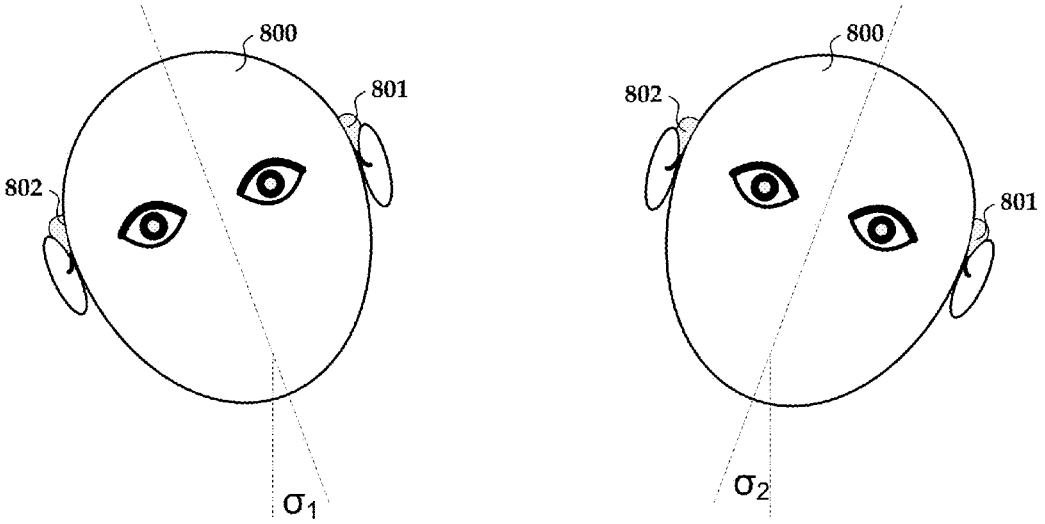

The user's motion used to determine the distance and relative orientation between the hearing devices may include the guided motion of the user in the direction of the perceived location during the process illustrated in the flow diagram of FIG. 3. Alternatively or additionally, the motion used to determine the distance and relative orientation between the hearing devices may include other guided motion of the user that is not the motion in the direction of the perceived location. In some embodiments, the motion used to determine the distance and relative orientation between the hearing devices may be non-guided motions of the user, e.g., motion of the user as the user goes through normal day-to-day activities. Motion used to determine the distance and relative orientation of the hearing devices is illustrated in FIGS. 8A and 8B that illustrate a top down view of the user's head 800. The motion used to determine the distance and/or relative orientation of the hearing devices 801, 802 may comprise translational motion of the hearing devices worn by the user along x, y, and z axes as shown in FIG. 8A. The motion used to determine the distance and/or relative orientation may include rotational motion of the hearing devices as the user's head rotates around the x, y, and/or z axes. Rotation of the user's head at various angles, θ, with respect to a z reference axis (head turning) as shown in FIG. 8B. Rotation of the user's head around the x axis at various angles, σ, with respect to the y axis (lateral head swinging) is shown in FIGS. 8C and 8D. Rotation of the user's head around the x axis (head tilting or nodding) is shown in FIGS. 4A and 4B.

In some implementations, the user's motion used to determine the distance and/or relative orientation between the hearing devices may be guided motion prompted by a voice provided through the virtual source. Alternatively or additionally, the motion used to determine the distance and/or relative orientation between the hearing devices may be motion of the user as the user goes about day-to-day activities. As previously discussed, the motion tracking of the hearing devices can be achieved with the devices' internal accelerometer, magnetometer and/or gyroscope sensors.

The distance and/or relative orientation between the left and right hearing devices can be an important factor in designing a number of algorithms used by the hearing devices. Such algorithms include, for example, beamforming algorithms of the microphone and/or signal processing algorithms for noise suppression, signal filtering, echo cancellation, and/or dereverberation.

The distance between the hearing devices and/or relative orientation between the hearing devices can vary significantly when the hearing devices are worn by different users. Additionally, the distance and/or relative orientation of the hearing devices can vary for the same user each time that the user puts on the hearing devices. Thus, when static, generic or idealized distance and/or relative orientation of the hearing devices are used for the hearing device algorithms, the algorithms are not individualized for the user and are suboptimal. Thus, it can be helpful to use the distance and/or relative orientation of left and right hearing devices as determined from the approaches described herein to modify in-situ 770 various algorithms of the left and right hearing devices to enhance operation of the hearing system.

In some implementations, the distance and/or relative orientation can be used to modify algorithms of binaural beamforming microphones to include steering vectors that are individualized for the user. The individualized steering vectors may be selected based on the distance and/or relative orientation of the two hearing devices estimated in real time. Additionally or alternatively, signal processing algorithms of the hearing devices can be modified based on the distance and/or relative orientation between the hearing devices. For example, binaural coherence based noise reduction and/or de-reverberation algorithms can be enhanced by individualized information about the spatial coherence between the left and right hearing devices in a diffuse sound field. The spatial coherence between left and right hearing devices can be more accurately modeled using the distance between the two hearing devices obtained from the approaches described herein.

Additionally and/or alternatively, in some applications the distance between the hearing devices and/or relative orientation of the hearing devices can be used to determine 760 if the hearing devices are being worn properly. Distance and/or relative orientation values between two hearing devices obtained by the hearing system that differ from generic values, usual values, or initial values obtained during a fitting session can indicate that the hearing devices are not positioned properly. In some implementations, the distance between the hearing devices and/or relative orientation of the hearing devices may be used to indicate to the user that the left and right hearing devices not properly worn or are switched.

The distance and/or relative orientation between the left and right hearing devices for any of the implementations discussed above can be estimated by solving a linear equation set treating the left and right hearing devices as parts on a rigid body. The translational and/or rotational motion of the hearing devices can be used to solve the rigid body problem to determine the distance and/or relative orientation between the hearing devices.

A relatively simple case occurs when the left and right hearing device have the same orientation. Assume that the velocity of the two hearing devices are $v_L$ and $v_R$, where the subscription L and R represent the left and right hearing devices, respectively. Similarly, the acceleration of the two hearing devices can be denoted as $a_L$ and $a_R$. The distance between two hearing devices is d, the rotation center of the head is denoted as $d_O$, the transitional velocity, transitional acceleration, angular velocity, and angular acceleration are denoted as $v_O$, $a_O$, and $\alpha_O$, respectively. If the relative position of one hearing device relative to the other hearing device does not change, then the motion of the two hearing devices can be modeled as a rigid body with the following equation of motion.

$$v_L+v_R=2v_O,$$

$$a_L+a_R=2a_O,$$

$$|a_L-a_O|=|\alpha_O|=\frac{2|v_L-v_O|^2}{d\sin(\theta_R)},$$

where $\theta_R$ is the angle between the horizontal rotational axis 899 and the straight line 898 connecting two hearing devices 801, 802 as indicated in FIG. 8A. If $\theta=\pi/2$, the distance, d, can be solved as:

$$d=\frac{|v_L-v_R|^2}{|a_L-a_R|}.$$

This solution is valid for the specific case where two hearing devices are worn in an ideal way on the head. The distance between two hearing devices can be estimated based on the above equation when the user's head turns with respect to the vertical rotational axis 897 shown in FIG. 8C.

In general, the left and right hearing devices would not be perfectly parallel to each other which was the assumption in the previous discussion. In general, the coordinate of one of the hearing devices is rotated in the horizontal and/or vertical planes relative to the other hearing device. Assuming the rotation transformation matrix from the coordinates of the right hearing device to the coordinates of the left hearing device is A, the transitional velocity and acceleration in either coordinates can be transformed to the other. Assuming that for each hearing device, the transitional velocity (v), transitional acceleration (a), angular velocity ($\omega$), and angular acceleration ($\alpha$) are all known in the local coordinates of the hearing device, then the following equation of motion assuming rigid body motion can be expressed:

$$\omega_R=A\cdot\omega_L, \quad [1]$$

$$\omega_L\times r=A^{-1}\cdot v_R\cdot v_L. \quad [2]$$

where r is the position vector of the left hearing device in the coordinate system of the right hearing device. If there are multiple observations of $\omega_L$'s and $\omega_R$'s (denoted by matrix formats $W_L=[\omega_{L1}, \omega_{L2}, \ldots \omega_{Ln}]^T$ and $W_R=[\omega_{R1}, \omega_{R2}, \ldots \omega_{Rn}]^T$ respectively) within a duration when A and r are unchanged, then Equation 1 can be rewritten as:

$$W_R^T=A\cdot W_L^T,$$

$$W_L A^T=W_R,$$

$$A^T=(W_L^T W_L)^{-1} W_L^T W_R.$$

The pseudo inverse in the above solution is not ill-conditioned if the motion of the user's head covers nodding, turning, and lateral swinging as discussed above. In addition, note that $A^{-1}=A^T$ should hold for all valid solutions of A as a violation of this condition would indicate that either A or r has changed.

To solve for r, the triple product identity is applied to Equation 2.

$$\omega_L\times r=A^{-1}\cdot v_R\cdot v_L,$$

$$(A^{-1}\cdot v_R\cdot v_L)\cdot(\omega_L\times r)=(A^{-1}\cdot v_R\cdot v_L)\cdot(A^{-1}\cdot v_R\cdot v_L),$$

$$r\cdot[(A^{-1}\cdot v_R-v_L)\times\omega_L]=(A^{-1}\cdot v_R\cdot v_L)\cdot(A^{-1}\cdot v_R\cdot v_L),$$

where $\beta=(A^{-1}\cdot v_R-v_L)\times\omega_L$ and $\lambda=(A^{-1}\cdot v_R-v_L)\cdot(A^{-1}\cdot v_R-v_L)$.

The matrix form of the above equation reads $$\beta r=\Lambda,$$

$$\Rightarrow r=(B^T B)^{-1} B^T \Lambda,$$

where $B=[\beta_1, \beta_2, \ldots \beta_n]^T$ and $\lambda=[\lambda_1, \lambda_2, \ldots \lambda_n]^T$.

In some embodiments, A and r can be estimated in real time using a least means square (LMS) algorithm and the update equations for the transpose of the rotational transformation matrix, $A^T$, can be derived as follows:

$$A^T(n+1)=A^T(n)+\mu_A\omega_L(n)e_{A^T}(n),$$

$$r(n-1)=r(n)+\mu_r\beta(n)e_r(n),$$

where $e_{A^T}(n)=\omega_r(n)-A(n)\cdot\omega_L(n)$ and $e_r(n)=\lambda(n)-\beta(n)^T\cdot r(n)$.

Figure 9A:
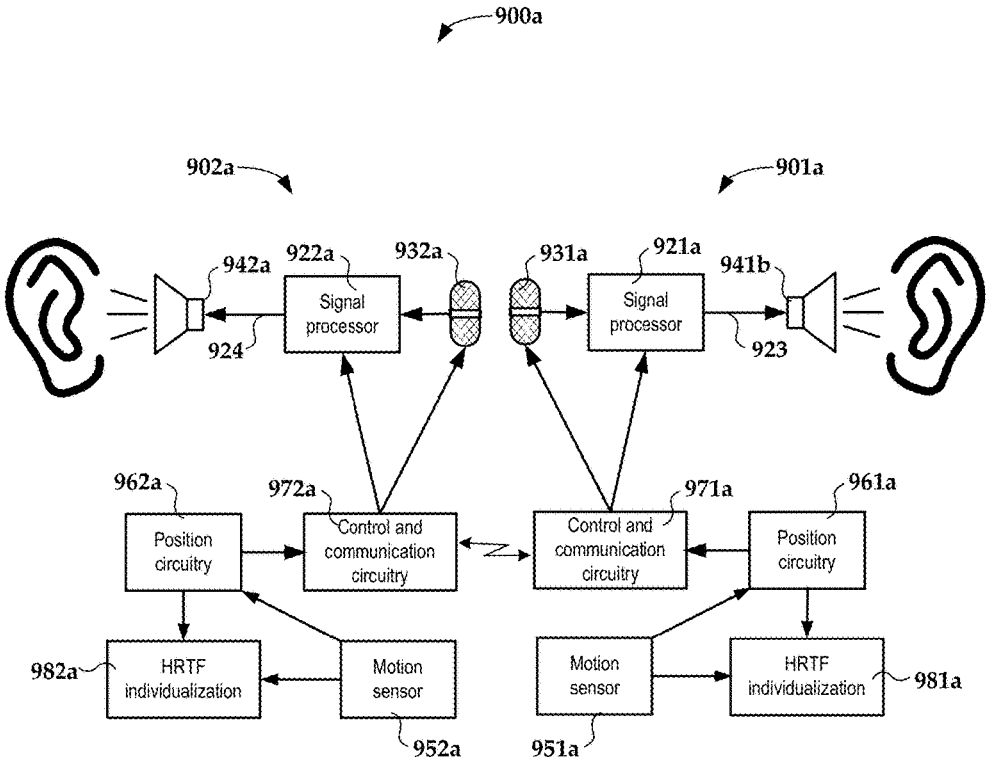
FIGS. 9A and 9B are block diagrams of hearing systems configured to determine the distance and/or relative orientation between left and right hearing devices in accordance with some embodiments.

FIG. 9A is a block diagram of a hearing system 900*a* configured to implement the process discussed above for determining the distance and/or relative orientation between the left and right hearing devices 901*a*, 902*a*. The hearing devices 901*a*, 902*a* include microphones 931*a*, 932*a* that pick up acoustic sounds and convert the acoustic sounds to electrical signals. The microphone 931*a*, 932*a* may comprise a beamforming microphone array that includes beamforming control circuitry configured to focus the sensitivity to sound through steering vectors. Signal processing circuitry 921*a*, 922*a*, amplifies, filters, digitizes and/or otherwise processes the electrical signals from the microphone 931*a*, 932*a*. The signal processing circuitry 921*a*, 922*a* may include a filter implementing an HRTF that adds spatialization cues to the electrical signal. The signal processing circuitry 921*a*, 922*a* may include various algorithms, such as noise reduction, echo cancellation, dereverberation algorithms, etc., that enhance the sound quality of sound picked up by the microphones 931*a*, 932*a*. Electrical signals 923, 924 output by the signal processing circuitry 921*a*, 922*a* are played to the user of the hearing devices 901*a*, 902*a* through a speaker 941*a*, 942*a* of the hearing device 901, 902. The electrical signals 923, 924 may include spatialization cues provided by the HRTF that assist the user in localizing a sound source.

As the user of the hearing system 900*a* makes guided motions and/or unguided motions, motion sensors 951*a*, 952*a* track the motion of the user. The motion sensor 951*a*, 952*a* may comprise one or more accelerometers, one or more magnetometers, and/or one or more gyroscopes. A motion sensor may be disposed within the shell of each of the left and right hearing devices 901*a*, 902*a*. One or both of the hearing devices 901*a*, 902*a* include position circuitry 961*a*, 962*a* configured to use the motion of the user tracked by the motion sensors 951*a*, 952*a* to determine the relative position of the hearing devices 901*a*, 902*a*, wherein the relative position includes one or both of the distance between the hearing devices and/or the relative orientation of the hearing devices 901*a*, 902*a* as described above. In some embodiments, only one of the hearing devices 901*a*, 902*a* includes the position circuitry 961*a*, 962*a* and in other embodiments, the position circuitry 961*a*, 962*a* is distributed between both hearing devices 901*a*, 902*a*. Information related to the relative positions of the hearing devices 901*a*, 902*a*, such as motion information from the motion sensors 951*a*, 952*a*, may be transferred from one hearing device 901*a*, 902*a* to the other hearing device 902*a*, 901*a* via control and communication circuitry 971*a*, 972*a*. The control and communication circuitry 971*a*, 972*a* is configured to establish a wireless link for transferring information between the hearing devices 901*a*, 902*a*. For example, the wireless link may comprise a near field magnetic induction (NFMI) communication link configured to transfer information unidirectionally or bidirectionally between the hearing devices 901*a*, 902*a*.

The distance and/or orientation information determined by the position circuitry 961*a*, 962*a* is provided to the control circuitry 971*a*, 972*a* which may use the distance and/or orientation information to individualize the algorithms of the signal processor 921*a*, 922*a* and/or the algorithms of the beamforming microphone 931*a*, 932*a*, and/or other hearing device functionality. In some embodiments, the distance and/or relative orientation between the devices 901*a*, 902*a* can be used to determine if the hearing devices 901*a*, 902*a* are properly worn. The hearing device 901*a*, 902*a* may provide an audible indication (positive tone sequence) to the user indicating that the hearing devices are in the proper position and/or may provide a different audible indication (negative tone sequence) to the user indicating that the hearing devices are not in the proper position. In some embodiments, if the hearing devices are not positioned properly, instructions played to the user via the signal source that provide directions regarding how to correct the position the hearing devices to enhance operation. Optionally, the position circuitry 961*a*, 962*a* may calculate the ITD and/or ILD for the user based on the motion information. The ITD and/or ILD can be used by the HRTF individualization circuitry 981*a*, 982*a* to modify the all-pass component of the HRTF of the hearing device 901*a*, 902*a*. The HRTF determined by the HRTF individualization circuitry 981*a*, 982*a* is implemented by a filter of the signal processing circuitry 922*a*, 922*b* to add spatialization cues to the electrical signal.

Figure 9B:
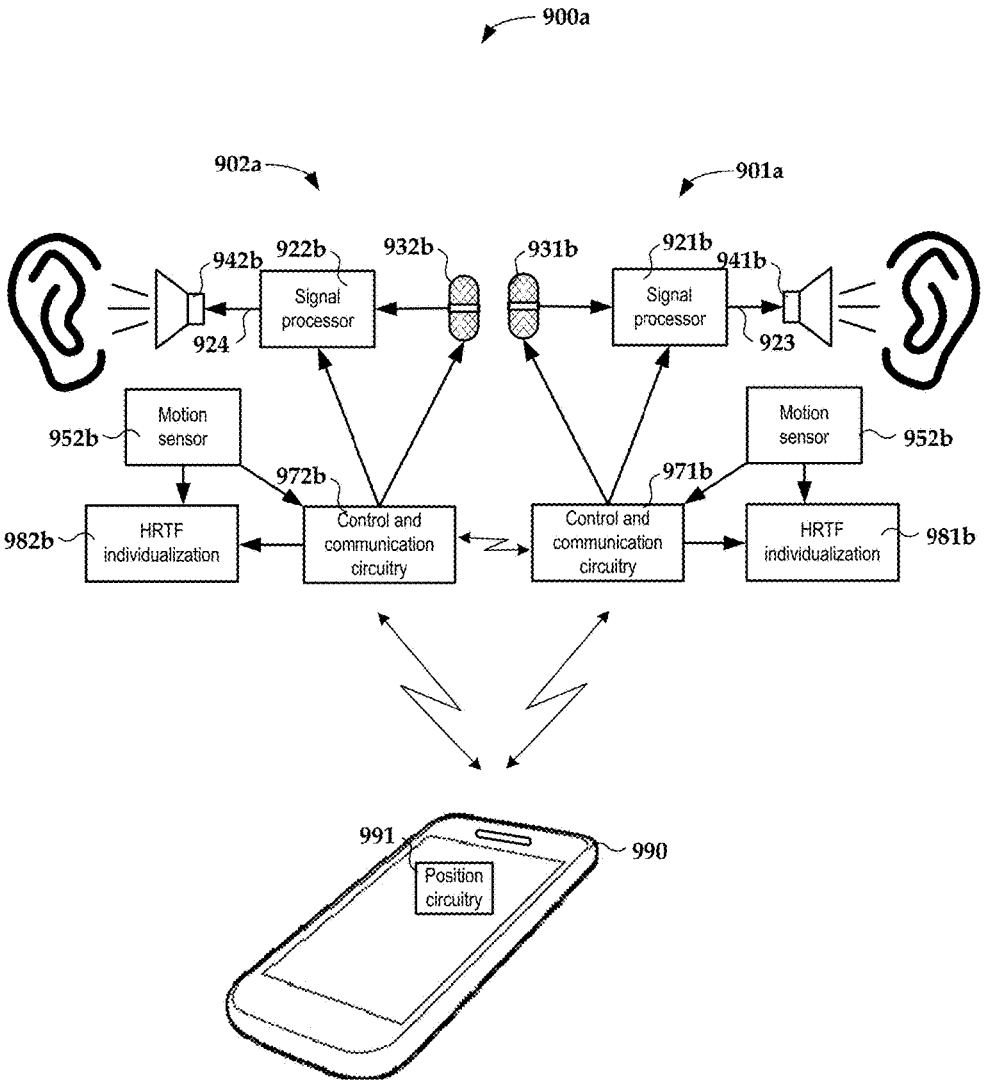

FIG. 9B is a block diagram of a hearing system 900*b* that includes position circuitry 991 located in an accessory device 990. The accessory device 990 may be a portable device such as a smartphone communicatively coupled, e.g., via an NFMI, radio frequency (RF), Bluetooth®, or other type of communication, to one or both of the hearing devices 901*b*, 902*b*. As the user of the hearing system 900*b* makes guided motions, e.g., motion in the direction of the perceived location, other guided motions, and/or unguided motions, motion sensors 951*b*, 952*b* track the motion of the user. The motion sensors 951*b*, 952*b*, e.g., one or more internal accelerometers, magnetometers, and/or gyroscopes, provide motion information to the control and communication circuitry 971*b*, 972*b* which transfers the motion information to position circuitry 991 disposed in the accessory device 990. The position circuitry 991 determines relative positions of the hearing devices 901*b*, 902*b*, including the distance between and/or relative orientation of the hearing devices 901*b*, 902*b* as described in more detail above. In addition to wireless communication between the hearing device 901*b*, 902*b* and the accessory device 990, the control and communication circuitry 971*b*, 972*b* may be configured to establish a wireless communication link between the hearing devices 901*b*, 902*b*. As previously discussed, the wireless link between the hearing devices 901*b*, 902*b* may comprise an NFMI communication link configured to transfer information unidirectionally or bidirectionally between the hearing devices 901*b*, 902*b*.

The distance and/or orientation information determined by the position circuitry 991 is provided to the control circuitry 971*b*, 972*b* via the wireless link. The control circuitry 971*b*, 972*b* uses the distance and/or relative orientation information to individualize the algorithms of the signal processor 921*b*, 922*b* and/or algorithms of the beamforming microphone 931*b*, 932*b* and/or other hearing device functionality. The signal processing circuitry 921*b*, 922*b* may include a filter implementing an HRTF that adds spatialization cues to the output electrical signal 923, 924 of the signal processing circuitry 921*b*, 922*b*. In some embodiments, the distance and/or relative orientation between the devices 901*b*, 902*b* can be used to determine if the hearing devices 901*b*, 902*b* are properly worn. The hearing device 901*b*, 902*b* may provide an audible sound or other indication that inform the user as to whether the hearing devices are properly worn. In some embodiments, the hearing device 901*b*, 902*b* may communicate to the accessory device that provides a visual message indicating whether the hearing devices are properly worn.

Optionally, the position circuitry 991 may calculate the ITD and/or ILD for the user based on the motion information. The ITD and/or ILD can be used by the HRTF individualization circuitry 981*b*, 982*b* to modify the all-pass component of HRTF of the hearing device 901*b*, 902*b*. The minimum phase component of the HRTF may be modified based on the motion of the user in the direction of the perceived location of the virtual source or based on other motions of the user as previously discussed.

Embodiments disclosed herein include:

Embodiment 1

A system comprising:

at least one hearing device configured to be worn by a user, each hearing device comprising:

a signal source configured to provide an electrical signal representing a sound of a virtual source;

a filter configured to implement a head related transfer function (HRTF) to add spatialization cues associated with a virtual location of the virtual source to the electrical signal and to output a filtered electrical signal that includes the spatialization cues; and a speaker configured to convert the filtered electrical signal into an acoustic sound and to play the acoustic sound to the user of the hearing device;

motion tracking circuitry configured to track motion of the user as the user moves in a direction of a perceived location that the user perceives to be the virtual location of the virtual source; and HRTF individualization circuitry configured to determine a difference between the virtual location of the virtual source and the perceived location in response to the motion of the user and to individualize the HRTF for the user based on the difference by modifying one or both of a minimum phase component of the HRTF associated with vertical localization and an all-pass component of the HRTF associated with horizontal localization.

Embodiment 2

The system of embodiment 1, wherein the HRTF individualization circuitry is configured to modify the minimum phase component of the HRTF based on the difference between the virtual location and the perceived location without modifying the all-pass component of the HRTF based on the difference between the virtual location and the perceived location.

Embodiment 3

The system of embodiment 2, wherein:

the motion tracking circuitry is configured to detect a second motion of the user unrelated to the motion of the user as the user moves in the direction of the perceived location; and the HRTF individualization circuitry is configured to modify the all-pass component of the HRTF based on the second motion of the user.

Embodiment 4

The system of any of embodiments 1 through 3, wherein:

the at least one hearing device comprises left and right hearing devices worn by the user;

the motion tracking circuitry is configured to detect a second motion of the user unrelated to the motion of the user as the user moves in the direction of the perceived location; and further comprising position circuitry disposed within one or both of the left and right hearing devices, the position circuitry configured to determine one or both of distance between the left and right hearing devices and relative orientation of the left and right hearing devices based on the motion of the user in the direction of the perceived location or to determine one or both of the distance and relative orientation of the left and right hearing devices based on the second motion of the user.

Embodiment 5

The system of embodiment 4, wherein each hearing device further comprising:

at least one microphone;

a signal processor configured to process signals picked up by the microphones; and control circuitry configured to individualize algorithms of one or both of the microphone and the signal processor based on one or both of the distance between the left and right hearing devices and the relative orientation of the hearing devices.

Embodiment 6

The system of embodiment 4, wherein the position circuitry is configured to determine if the left and right hearing devices are correctly positioned based on one or both of the distance and the relative orientation of the left and right hearing devices.

Embodiment 7

The system of any of embodiments 1 through 6, further comprising:

one or more microphones disposed within the hearing device, the microphones configured to detect a sound produced by one or more speakers located external to the hearing device; and the HRTF individualization circuitry is configured to determine one or both of an interaural time difference (ITD) and an interaural level difference (ILD) based on the sound of the external speakers and to modify the all-pass component based on one or both of the ITD and the ILD.

Embodiment 8

The system of any of embodiments 1 through 7, wherein the motion tracking circuitry includes one or more motion sensors disposed within the hearing device worn by the user.

Embodiment 9

The system of any of embodiments 1 through 7, wherein the motion tracking circuitry comprises one or more external sensors located external to the hearing device worn by the user.

Embodiment 10

The system of any of embodiments 1 through 9, wherein the HRTF individualization circuitry is configured to iteratively individualize the minimum phase HRTF until the difference between the virtual location of the virtual source and the perceived location is within a predetermined threshold value.

Embodiment 11

A system comprising:

one or more hearing devices configured to be worn by a user, each hearing device comprising:

a signal source configured to provide an electrical signal representing a sound of a virtual source;

a filter configured to implement a head related transfer function (HRTF) to add spatialization cues associated with a virtual location of the virtual source to the electrical signal and to output a filtered electrical signal that includes the spatialization cues; and a speaker configured to convert the filtered electrical signal into an acoustic sound and to play the acoustic sound to the user;

motion tracking circuitry configured to track motion of the user as the user moves in a direction of a perceived location that the user perceives as the virtual location of the virtual source; and head related transfer function (HRTF) individualization circuitry configured to determine a difference between the virtual location and the perceived location based on the motion of the user and to individualize the HRTF for the user based on the difference by modifying a minimum phase component of the HRTF associated with vertical localization.

Embodiment 12

The system of embodiment 11, further comprising:

one or more microphones disposed within the hearing device, the microphones configured to detect an external sound produced externally from the hearing device; and the HRTF individualization circuitry is configured to determine one or both of an ITD and an ILD based on the external sound and to modify an all-pass component of the HRTF based on one or both of the ITD and the ILD.

Embodiment 13

The system of embodiment 12, wherein the external sound is ambient noise.

Embodiment 14

The system of embodiment 12, further comprising at least one external speaker arranged external to the hearing device and configured to generate the external sound.

Embodiment 15

The system of embodiment 14, wherein the HRTF individualization circuitry is configured to design a peaking filter based on the difference.

Embodiment 16

A method of operating a hearing device comprising:

producing a sound having spatialization cues associated with a virtual location of a virtual source;

playing, through a speaker of at least one hearing device worn by a user, the sound to a user of the hearing device;

tracking motion of the user as the user moves in a direction of a perceived location that the user perceives as the virtual location of the virtual source;

determining a difference between the virtual location and the perceived location based on the motion of the user;

individualizing a head related transfer function (HRTF) for the user based on the difference by modifying a minimum phase component of the HRTF associated with vertical localization.

Embodiment 17

The method of embodiment 16, further comprising individualizing an all-pass component of the HRTF based on at least one of the motion of the user in the direction of the perceived location and a second motion of the user different from the motion of the user in the direction of the perceived location;

Embodiment 18

The method of embodiment 16, further comprising individualizing an all-pass component of the HRTF based on an external sound produced externally from the hearing device and detected using one or more microphones of the hearing device.

Embodiment 19

The method of any of embodiments 16 through 18, wherein individualizing the HRTF comprises:

designing a peaking filter based on the difference; and subsequently convolving the HRTF with the peaking filter to modify the minimum phase component of the HRTF.

Embodiment 20

The method of embodiment 19, further comprising iteratively modifying the minimum phase component the HRTF until the difference between the virtual location and the perceived location is within a predetermined threshold value.

It is understood that the embodiments described herein may be used with any hearing device without departing from the scope of this disclosure. The devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing devices referenced in this patent application may include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples, drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to implement a number of signal processing tasks. In such embodiments, analog components are in communication with the processor to perform signal tasks, such as microphone reception, or receiver sound embodiments (e.g., in applications where such transducers are used). In various embodiments, different realizations of the block diagrams, circuits, and processes set forth herein may occur without departing from the scope of the present subject matter.

The present subject matter is demonstrated for hearing devices, including hearables, hearing assistance devices, and/or hearing aids, including but not limited to, behind-the-ear (BTE), in-the-ear (ITE), in-the-canal (ITC), receiver-in-canal (RIC), or completely-in-the-canal (CIC) type hearing devices. It is understood that behind-the-ear type hearing devices may include devices that reside substantially behind the ear or over the ear. The hearing devices may include hearing devices of the type with receivers associated with the electronics portion of the behind-the-ear device, or hearing devices of the type having receivers in the ear canal of the user, including but not limited to receiver-in-canal (RIC) or receiver-in-the-ear (RITE) designs. The present subject matter can also be used in cochlear implant type hearing devices such as deep insertion devices having a transducer, such as a receiver or microphone, whether custom fitted, standard, open fitted or occlusive fitted. It is understood that other hearing devices not expressly stated herein may be used in conjunction with the present subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. A system comprising:

at least one hearing device configured to be worn by a user, each hearing device comprising:

a signal source configured to provide an electrical signal representing a sound of a virtual source;

a filter configured to implement a head related transfer function (HRTF) to add spatialization cues associated with a virtual location of the virtual source to the electrical signal and to output a filtered electrical signal that includes the spatialization cues; and a speaker configured to convert the filtered electrical signal into an acoustic sound and to play the acoustic sound to the user of the hearing device;

motion tracking circuitry configured to track motion of the user as the user moves in a direction of a perceived location that the user perceives to be the virtual location of the virtual source; and HRTF individualization circuitry configured to determine a difference between the virtual location of the virtual source and the perceived location in response to the motion of the user and to individualize the HRTF for the user based on the difference by modifying one or both of a minimum phase component of the HRTF associated with vertical localization and an all-pass component of the HRTF associated with horizontal localization.

2. The system of claim 1, wherein the HRTF individualization circuitry is configured to modify the minimum phase component of the HRTF based on the difference between the virtual location and the perceived location without modifying the all-pass component of the HRTF based on the difference between the virtual location and the perceived location.

3. The system of claim 2, wherein:

the motion tracking circuitry is configured to detect a second motion of the user unrelated to the motion of the user as the user moves in the direction of the perceived location; and the HRTF individualization circuitry is configured to modify the all-pass component of the HRTF based on the second motion of the user.

4. The system of claim 1, wherein:

the at least one hearing device comprises left and right hearing devices worn by the user;

the motion tracking circuitry is configured to detect a second motion of the user unrelated to the motion of the user as the user moves in the direction of the perceived location; and further comprising position circuitry disposed within one or both of the left and right hearing devices, the position circuitry configured to determine one or both of distance between the left and right hearing devices and relative orientation of the left and right hearing devices based on the motion of the user in the direction of the perceived location or to determine one or both of the distance and relative orientation of the left and right hearing devices based on the second motion of the user.

5. The system of claim 4, wherein each hearing device further comprising:

at least one microphone;

a signal processor configured to process signals picked up by the microphones; and control circuitry configured to individualize algorithms of one or both of the microphone and the signal processor based on one or both of the distance between the left and right hearing devices and the relative orientation of the hearing devices.

6. The system of claim 4, wherein the position circuitry is configured to determine if the left and right hearing devices are correctly positioned based on one or both of the distance and the relative orientation of the left and right hearing devices.

7. The system of claim 1, further comprising:

one or more microphones disposed within the hearing device, the microphones configured to detect a sound produced by one or more speakers located external to the hearing device; and the HRTF individualization circuitry is configured to determine one or both of an interaural time difference (ITD) and an interaural level difference (ILD) based on the sound of the external speakers and to modify the all-pass component based on one or both of the ITD and the ILD.

8. The system of claim 1, wherein the motion tracking circuitry includes one or more motion sensors disposed within the hearing device worn by the user.

9. The system of claim 1, wherein the motion tracking circuitry comprises one or more external sensors located external to the hearing device worn by the user.

10. The system of claim 1, wherein the HRTF individualization circuitry is configured to iteratively individualize the minimum phase HRTF until the difference between the virtual location of the virtual source and the perceived location is within a predetermined threshold value.

11. A system comprising:

one or more hearing devices configured to be worn by a user, each hearing device comprising:

a signal source configured to provide an electrical signal representing a sound of a virtual source;

a filter configured to implement a head related transfer function (HRTF) to add spatialization cues associated with a virtual location of the virtual source to the electrical signal and to output a filtered electrical signal that includes the spatialization cues; and a speaker configured to convert the filtered electrical signal into an acoustic sound and to play the acoustic sound to the user;

motion tracking circuitry configured to track motion of the user as the user moves in a direction of a perceived location that the user perceives as the virtual location of the virtual source; and head related transfer function (HRTF) individualization circuitry configured to determine a difference between the virtual location and the perceived location based on the motion of the user and to individualize the HRTF for the user based on the difference by modifying a minimum phase component of the HRTF associated with vertical localization.

12. The system of claim 11, further comprising:

one or more microphones disposed within the hearing device, the microphones configured to detect an external sound produced externally from the hearing device; and the HRTF individualization circuitry is configured to determine one or both of an ITD and an ILD based on the external sound and to modify an all-pass component of the HRTF based on one or both of the ITD and the ILD.

13. The system of claim 12, wherein the external sound is ambient noise.

14. The system of claim 12, further comprising at least one external speaker arranged external to the hearing device and configured to generate the external sound.

15. The system of claim 14, wherein the HRTF individualization circuitry is configured to design a peaking filter based on the difference.

16. A method of operating a hearing device comprising:

producing a sound having spatialization cues associated with a virtual location of a virtual source;

playing, through a speaker of at least one hearing device worn by a user, the sound to a user of the hearing device;

tracking motion of the user as the user moves in a direction of a perceived location that the user perceives as the virtual location of the virtual source;

determining a difference between the virtual location and the perceived location based on the motion of the user;

individualizing a head related transfer function (HRTF) for the user based on the difference by modifying a minimum phase component of the HRTF associated with vertical localization.

17. The method of claim 16, further comprising individualizing an all-pass component of the HRTF based on at least one of the motion of the user in the direction of the perceived location and a second motion of the user different from the motion of the user in the direction of the perceived location.

18. The method of claim 16, further comprising individualizing an all-pass component of the HRTF based on an external sound produced externally from the hearing device and detected using one or more microphones of the hearing device.

19. The method of claim 16, wherein individualizing the HRTF comprises:

designing a peaking filter based on the difference;

subsequently convolving the HRTF with the peaking filter to modify the minimum phase component of the HRTF.

20. The method of claim 19, further comprising iteratively modifying the minimum phase component the HRTF until the difference between the virtual location and the perceived location is within a predetermined threshold value.

* * * * *